US012420336B2

(12) United States Patent
Mathew et al.

(10) Patent No.: US 12,420,336 B2
(45) Date of Patent: Sep. 23, 2025

(54) ANTI-FRETTING COATING COMPOSITION AND COATED COMPONENTS

(71) Applicant: General Electric Company, Schenectady, NY (US)

(72) Inventors: Paul Mathew, Bangalore (IN); Mohandas Nayak, Bangalore (IN); Sathisha Chikkabikkodu Hanum, Bangalore (IN); Monty Lee Shelton, Loveland, OH (US)

(73) Assignee: General Electric Company, Evendale, OH (US)

( * ) Notice: Subject to any disclaimer, the term of this patent is extended or adjusted under 35 U.S.C. 154(b) by 54 days.

(21) Appl. No.: 17/473,281

(22) Filed: Sep. 13, 2021

(65) Prior Publication Data

US 2022/0280998 A1 Sep. 8, 2022

(30) Foreign Application Priority Data

Mar. 3, 2021 (IN) ..... 202111008896

(51) Int. Cl.
*B22F 1/00* (2022.01)
*B22F 1/05* (2022.01)
*B22F 1/12* (2022.01)

(52) U.S. Cl.
CPC ..... *B22F 1/12* (2022.01); *B22F 1/05* (2022.01); *B22F 1/09* (2022.01); *B22F 2301/15* (2013.01);
(Continued)

(58) Field of Classification Search
CPC ..... B22F 1/12; B22F 1/05; B22F 1/09; B22F 2301/15; B22F 2301/20; B22F 2302/253; B22F 7/06; F05D 2230/90; F05D 5/299; C22C 1/05; C22C 1/02; C22C 1/04; C22C 1/06; C22C 1/11; C22C 1/134; C22C 1/18; C22C 24/04; C22C 24/08; C22C 32/0026; C23C 28/321; C23C 28/345
See application file for complete search history.

(56) References Cited

U.S. PATENT DOCUMENTS 4,124,737 A 11/1978 Wolfla et al.
4,332,618 A 6/1982 Ballard
(Continued)

FOREIGN PATENT DOCUMENTS

CN 102002708 A 4/2011
CN 103600066 A 2/2014
(Continued)

*Primary Examiner* — Kevin C T Li
(74) *Attorney, Agent, or Firm* — Dority & Manning, P.A.

(57) ABSTRACT

An anti-fretting coating composition that is operationally stable at temperatures of 800° F. to 2650° F. is provided. The anti-fretting coating composition primarily includes cobalt and aluminum oxide and may also include other modifying phases that enhance the overall tribological performance. A component coated with the anti-fretting coating composition is also provided. The component includes a substrate having a first contact surface shaped to cooperate with a second contact surface of an abutting member in a manner which can develop wear between the first contact surface and the second contact surface. The first contact surface includes an anti-fretting coating thereon formed from the disclosed anti-fretting coating composition.

13 Claims, 3 Drawing Sheets

(52) U.S. Cl.
CPC ..... *B22F 2301/20* (2013.01); *B22F 2302/253* (2013.01)

(56) References Cited

U.S. PATENT DOCUMENTS

| | | | | |
|---|---|---|---|---|
| 4,902,326 | A | 2/1990 | Jarmon | |
| 5,079,100 | A | 1/1992 | Descamp et al. | |
| 5,281,559 | A | 1/1994 | Bansal | |
| 5,312,696 | A | 5/1994 | Beers et al. | |
| 5,455,119 | A | 10/1995 | Taylor et al. | |
| 6,284,325 | B1 | 9/2001 | Eaton, Jr. et al. | |
| 6,422,818 | B2 | 7/2002 | Mashey | |
| 8,371,816 | B2 | 2/2013 | Piersall et al. | |
| 9,957,629 | B2 | 5/2018 | Foster et al. | |
| 2008/0066288 | A1* | 3/2008 | Patrick | F01D 5/288 29/889.7 |
| 2009/0297720 | A1* | 12/2009 | Ramgopal | C23C 30/00 427/455 |
| 2011/0312860 | A1* | 12/2011 | Mathew | C23C 30/00 508/150 |
| 2013/0157078 | A1 | 6/2013 | Onal et al. | |
| 2017/0122560 | A1 | 5/2017 | Nagaraj | |
| 2018/0202300 | A1* | 7/2018 | Landwehr | C04B 41/009 |
| 2019/0063250 | A1 | 2/2019 | Shi et al. | |
| 2019/0093497 | A1* | 3/2019 | Ndamka | C04B 41/5024 |
| 2020/0263307 | A1 | 8/2020 | Anand et al. | |

FOREIGN PATENT DOCUMENTS

| | | | | |
|---|---|---|---|---|
| CN | 104313446 | A | 1/2015 | |
| CN | 107177843 | A | 9/2017 | |
| CN | 108130530 | A | 6/2018 | |
| WO | WO95/25185 | | 9/1995 | |
| WO | WO-2009129380 | A2 * | 10/2009 | C10M 103/06 |

* cited by examiner

ANTI-FRETTING COATING COMPOSITION AND COATED COMPONENTS

PRIORITY INFORMATION

The present application claims priority to Indian Patent Application Number 202111008896 filed on Mar. 3, 2021.

FIELD

The present subject matter relates generally to anti-fretting coating compositions and components coated with the same. More particularly, the present subject matter relates to gas turbine engine components having an anti-fretting wear coating thereon.

BACKGROUND

Metal components are used in a wide variety of industrial applications, under a diverse set of operating conditions. In many cases, the components are provided with coatings that impart various characteristics, such as corrosion resistance, heat resistance, oxidation resistance, and wear resistance. As one example, the various components of turbine engines are often coated with thermal barrier coatings, to effectively increase the temperature at which they can operate. Other examples of articles which require some sort of protective coating include pistons used in internal combustion engines and other types of machines.

Wear-resistant coatings (often referred to as "wear coatings") are frequently used on turbine engine components. Wear coatings provide protection in areas where components may rub against each other, since the rubbing—especially high frequency rubbing—can damage the part. A specific type of wear is referred to as "fretting". Fretting can often result from very small movements or vibrations at the juncture between mating components, e.g., in the compressor and/or fan section of gas turbine engines. For example, fretting can occur in regions where shroud segments in the turbine section rub up against each other during operation of the engine. This type of wear can necessitate premature repair or replacement of one or more of the affected components. Various alloys, such as those based on nickel or cobalt, are susceptible to fretting and other modes of wear. This relatively small amplitude displacement can sometimes be combined with impact and hence a combination of fretting and impact wear can also occur on engine parts.

A variety of wear coatings have been developed. However, such commercially available wear coatings tend to oxidize or gall at temperatures greater than 1500° F., making them unsuitable for certain sections of the engine that operate at temperatures greater than 1500° F. Given that certain sections of gas turbine engines, such as high-bypass turbofan engines, operate at temperatures well above 1800° F., improved wear coatings, such as anti-fretting coatings, are needed that are operationally stable at higher temperatures, such as those above 1800° F.

BRIEF DESCRIPTION

Aspects and advantages of the invention will be set forth in part in the following description, or may be obvious from the description, or may be learned through practice of the invention.

Exemplary aspects of the present disclosure are directed to an anti-fretting coating composition. The anti-fretting coating composition includes from about 5 weight % to about 80 weight % of a cobalt-containing powder and from about 1 weight % to about 40 weight % of an aluminum-containing powder.

Other exemplary aspects are directed to a component having a substrate having a first contact surface shaped to cooperate with a second contact surface of an abutting member in a manner which can develop wear between the first contact surface and the second contact surface, the first contact surface having an anti-fretting coating thereon formed from an anti-fretting coating composition, the anti-fretting coating composition comprising from about 5 weight % to about 80 weight % of a cobalt-containing powder and from about 1 weight % to about 40 weight % of an aluminum-containing powder.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION

Figure 1:
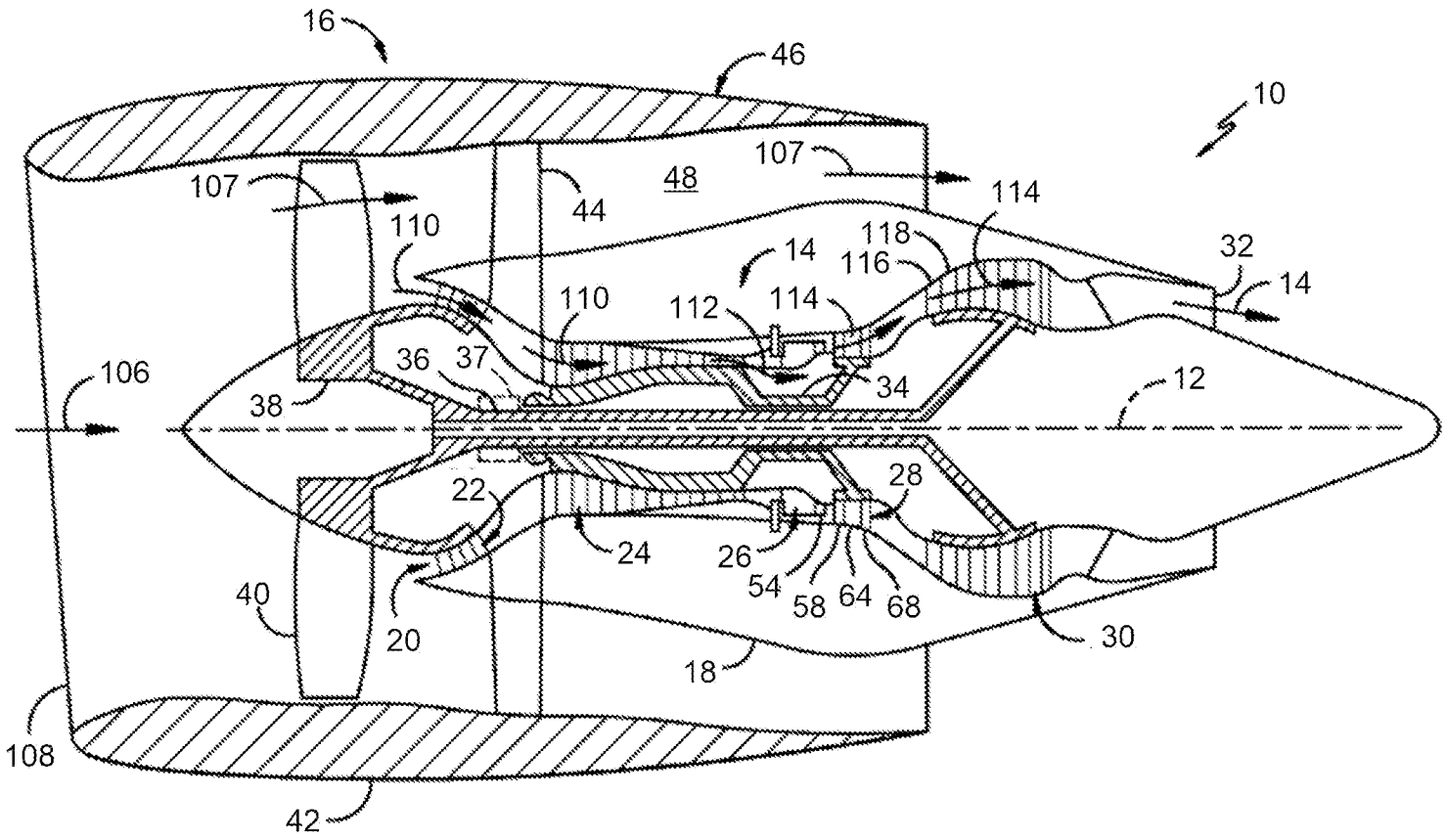
FIG. 1 is a schematic cross-sectional view of a gas turbine engine in accordance with embodiments of the present disclosure.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

The singular forms "a," "an," and "the" include plural references unless the context clearly dictates otherwise.

As used herein, the terms "first", "second", and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Further, as used herein, the terms "axial" or "axially" refer to a dimension along a longitudinal axis of an engine. The term "forward" used in conjunction with "axial" or "axially" refers to a direction toward the engine inlet, or a component being relatively closer to the engine inlet as compared to another component. The term "rear" used in conjunction with "axial" or "axially" refers to a direction toward the engine nozzle, or a component being relatively closer to the engine nozzle as compared to another component. The terms "radial" or "radially" refer to a dimension extending between a center longitudinal axis of the engine and an outer engine circumference.

As used herein the term "powder" or the like refers to a collection of particles. The particles may be of any configuration, shape or size as long as they are suitable for the flowability, dispersion and/or compaction thereof. As used herein the term "median particle size" refers to median value of the particle size distribution, also known as d50 median.

Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin to the stated value.

Here and throughout the specification and claims, range limitations are combined and interchanged, such ranges are identified and include all the sub-ranges contained therein unless context or language indicates otherwise. For example, all ranges disclosed herein are inclusive of the endpoints, and the endpoints are independently combinable with each other.

Generally, the present subject matter provides a wear-resistant, anti-fretting coating composition for protecting at least a portion of a substrate. The anti-fretting coating composition is operationally stable at temperatures of 1800° F. or greater. The anti-fretting coating composition includes cobalt and aluminum. Optionally, the anti-fretting coating can include a viscoelasticity-modifying composition containing aluminum oxide, silicon dioxide, and calcium oxide. Components coated with the anti-fretting coating composition disclosed herein are also provided.

In some embodiments of the present invention, the substrate comprises a component of a turbine assembly, such as, for example, a gas turbine assembly or a gas power turbine assembly. Referring now to the drawings, FIG. 1 is a schematic cross-sectional view of an exemplary high-bypass turbofan type engine 10 herein referred to as "turbofan 10" as may incorporate various embodiments of the present disclosure. As shown in FIG. 1, the turbofan 10 has a longitudinal or axial centerline axis 12 that extends therethrough for reference purposes. In general, the turbofan 10 may include a core turbine or gas turbine engine 14 disposed downstream from a fan section 16.

The gas turbine engine 14 may generally include a substantially tubular outer casing 18 that defines an annular inlet 20. The outer casing 18 may be formed from multiple casings. The outer casing 18 encases, in serial flow relationship, a compressor section having a booster or low pressure (LP) compressor 22, a high pressure (HP) compressor 24, a combustion section 26, a turbine section including a high pressure (HP) turbine 28, a low pressure (LP) turbine 30, and a jet exhaust nozzle section 32. A high pressure (HP) shaft or spool 34 drivingly connects the HP turbine 28 to the HP compressor 24. A low pressure (LP) shaft or spool 36 drivingly connects the LP turbine 30 to the LP compressor 22. The (LP) spool 36 may also be connected to a fan spool or shaft 38 of the fan section 16. In particular embodiments, the (LP) spool 36 may be connected directly to the fan spool 38 such as in a direct-drive configuration. In alternative configurations, the (LP) spool 36 may be connected to the fan spool 38 via a speed reduction device 37 such as a reduction gear gearbox in an indirect-drive or geared-drive configuration. Such speed reduction devices may be included between any suitable shafts/spools within engine 10 as desired or required.

As shown in FIG. 1, the fan section 16 includes a plurality of fan blades 40 that are coupled to and that extend radially outwardly from the fan spool 38. An annular fan casing or nacelle 42 circumferentially surrounds the fan section 16 and/or at least a portion of the gas turbine engine 14. It should be appreciated by those of ordinary skill in the art that the nacelle 42 may be configured to be supported relative to the gas turbine engine 14 by a plurality of circumferentially-spaced outlet guide vanes 44. Moreover, a downstream section 46 of the nacelle 42 (downstream of the guide vanes 44) may extend over an outer portion of the gas turbine engine 14 so as to define a bypass airflow passage 48 therebetween.

During operation of the turbofan 10, as illustrated in FIG. 1, air 106 enters an inlet portion 108 of the turbofan 10. A first portion of the air 106 as indicated by arrow 107 is directed into the bypass flow passage 48 and a second portion of the air 106 as indicated by arrow 110 enters the inlet 20 of the LP compressor 22. The second portion of air 110 is progressively compressed as it is routed from the LP compressor 22 into the HP compressor 24. The second portion of the air 110 is further compressed as it is routed through the HP compressor 24, thus providing compressed air as indicated by arrow 112 to the combustion section 26 where it is mixed with fuel and burned to provide combustion gases as indicated by arrow 114.

The combustion gases 114 are routed through the HP turbine 28 where a portion of thermal and/or kinetic energy from the combustion gases 114 is extracted via the stator vanes 54, 64 and turbine rotor blades 58, 68 of the first and second stages 50, 60 respectively, thus causing the HP shaft or spool 34 to rotate, thereby supporting operation of the HP compressor 24. The combustion gases 114 are then routed through the LP turbine 30 where a second portion of thermal and kinetic energy is extracted from the combustion gases 114 via sequential stages of LP turbine stator vanes 116 and LP turbine rotor blades 118 that are coupled to the LP shaft or spool 36, thus causing the LP shaft or spool 36 to rotate, thereby supporting operation of the LP compressor 22 and/or rotation of the fan spool or shaft 38. The combustion gases 114 are then routed through the jet exhaust nozzle section 32 of the gas turbine engine 14.

Figure 2:
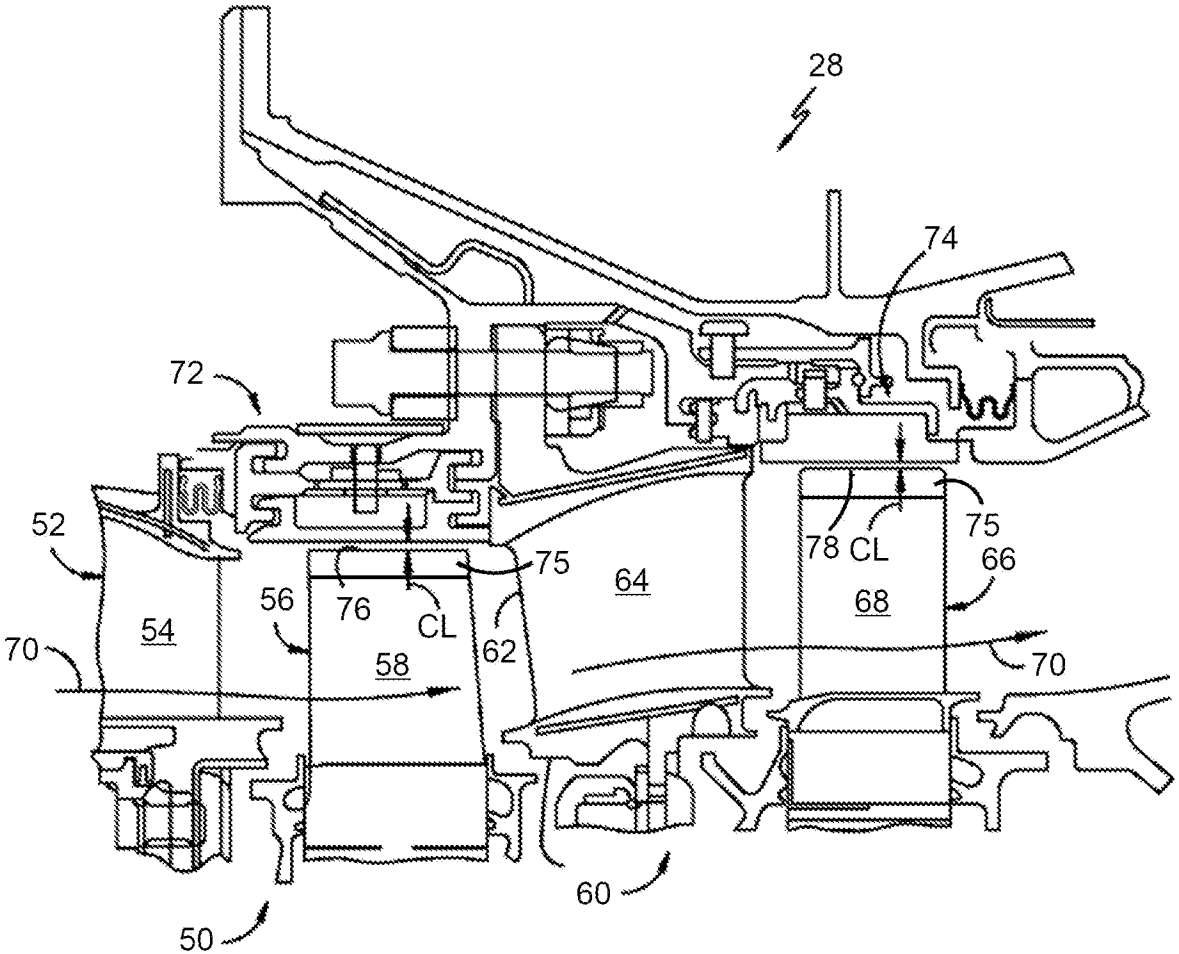
FIG. 2 is an enlarged cross-sectional side view of a high pressure turbine portion of a gas turbine engine in accordance with embodiments of the present disclosure.

FIG. 2 provides an enlarged cross sectioned view of the HP turbine 28 portion of the gas turbine engine 14 as shown in FIG. 1, as may incorporate various embodiments of the present invention. As shown in FIG. 2, the HP turbine 28 includes, in serial flow relationship, a first stage 50 which includes an annular array 52 of stator vanes 54 (only one shown) axially spaced from an annular array 56 of turbine rotor blades 58 (only one shown). The HP turbine 28 further includes a second stage 60 which includes an annular array 62 of stator vanes 64 (only one shown) axially spaced from an annular array 66 of turbine rotor blades 68 (only one shown). The turbine rotor blades 58, 68 extend radially outwardly from and are coupled to the HP spool 34 (FIG. 1). As shown in FIG. 2, the stator vanes 54, 64 and the turbine rotor blades 58, 68 at least partially define a hot gas path 70 for routing combustion gases from the combustion section 26 (FIG. 1) through the HP turbine 28.

As further shown in FIG. 2, the HP turbine may include one or more shroud assemblies, each of which forms an annular ring about an annular array of rotor blades. For example, a shroud assembly 72 may form an annular ring around the annular array 56 of rotor blades 58 of the first stage 50, and a shroud assembly 74 may form an annular ring around the annular array 66 of turbine rotor blades 68 of the second stage 60. In general, shrouds of the shroud assemblies 72, 74 are radially spaced from blade tips 76, 78 of each of the rotor blades 68. A radial or clearance gap CL is defined between the blade tips 76, 78 and the shrouds. The shrouds and shroud assemblies generally reduce leakage from the hot gas path 70. The shroud assemblies 72, 74 can be stationary shroud assemblies, that is they are configured in a fixed manner around the annular array of rotor blades and they do not rotate with the rotor blades. In embodiments, the blade tips 76,78 include an integral tip shroud 75 generally located at the outer extremity of the blade tips 76,78 as will be further discussed below. The integral tip shrouds 75 rotate with the blade tips 76, 78 during operation of the engine. Thus, the integral tip shrouds 75 can be referred to a rotating shrouds. It should be noted that the integral tip shrouds and shroud assemblies may additionally be utilized in a similar manner in the low pressure compressor 22, high pressure compressor 24, and/or low pressure turbine 30. Accordingly, shrouds and shrouds assemblies as disclosed herein are not limited to use in HP turbines, and rather may be utilized in any suitable section of a gas turbine engine, such as the low pressure turbine 30.

Figure 3:
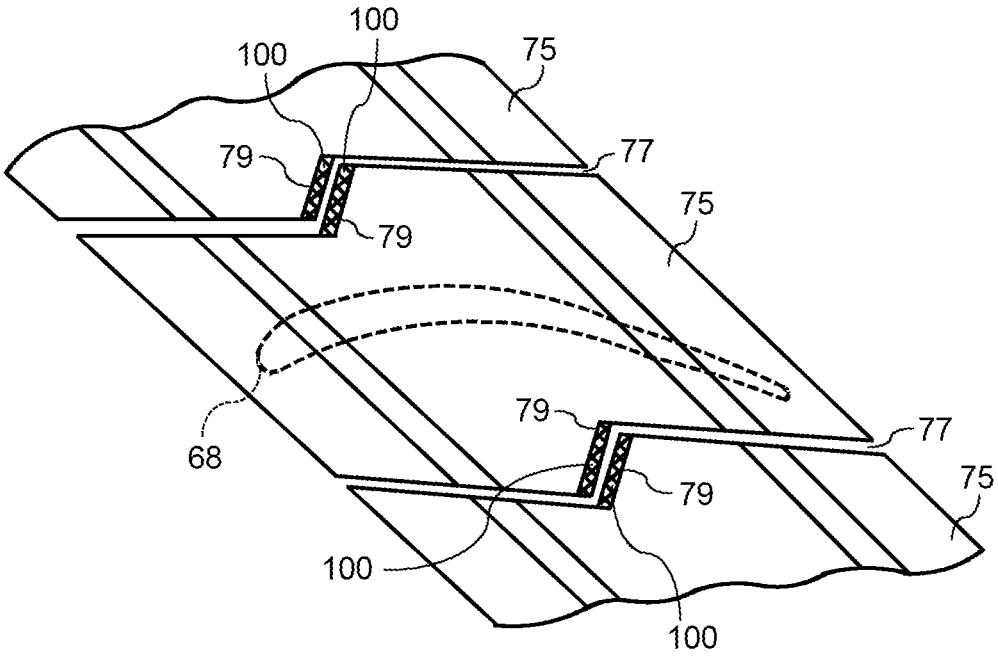
FIG. 3 illustrates a turbine blade tip shroud and a neighboring tip shroud as seen looking along the long axis of a turbine blade in accordance with embodiments of the present disclosure.

FIG. 3 depicts a particular embodiment of the present invention in which the component provided is a rotor blade, e.g. rotor blades 58 or turbine rotor blades 68 (FIG. 2), that includes an integral tip shroud 75 at the outer extremity of the blade tips 76,78. The tip shroud 75 is disposed on the radial end of the rotor blades 58 or the turbine rotor blades 68. The tip shroud 75 may serve to block leakage between the radial end of the rotor blades 58 or turbine rotor blades 68 and the shroud assemblies 72,74. In other words, the tip shroud 75 may help block a fluid flow (e.g., of the combustion gases 114) within the turbine section from passing from a pressure side to a suction side of the turbine rotor blades 68 through the radial or clearance gap CL defined between the blade tips 78 and the shroud assembly 74. Furthermore, the tip shroud 75 may also dampen vibrations in the rotor blades 58 and/or the turbine rotor blades 68. Each tip shroud 75 has two correspondingly opposite Z-shaped interlock notches 77, which allow tip shroud 75 to interlock with its neighboring tip shrouds 75. Anti-fretting coating composition 100 is applied to at least a portion of tip shroud 75, often on the interlock notch 77, to avoid excessive wear and fretting along interlock notch 77. In particular embodiments the anti-fretting coating composition is applied to a contact surface 79 of the interlock notch 77.

While tip shroud embodiments are disclosed, the description is not so limited. Indeed, the anti-fretting coating composition provided herein can be applied to any component in a gas turbine engine that abuts adjacent parts causing wear. For example, the anti-fretting coating composition can be applied to nozzles, shroud hangers, and any other component parts prone to wear or fretting. More specifically, the anti-fretting coating composition can be applied to components that experience high temperatures during operation, for example, on components in the hot gas flow path of the gas turbine engine that can experience temperatures ranging from 800° F. up to temperatures of about 2650° F. For example, while gas turbine engines are disclosed, the anti-fretting coating composition can be applied to components of any turbomachinery, reciprocating machinery, or power generating machinery that experience wear or fretting.

The anti-fretting coating composition is operationally stable at temperatures of from about 800° F. to about 2650° F., such as from about 900° F. to about 2550° F., such as from about 1000° F. to about 2450° F., such as from about 1100° F. to about 2350° F., such as from about 1200° F. to a bout 2250° F. As used herein, the term "operationally stable" means that the anti-fretting coating will not substantially deteriorate at the disclosed temperatures to the point at which it no longer is effective to prevent wear on the substrate on which it is disposed.

In embodiments, the anti-fretting coating composition includes cobalt. For example, the anti-fretting coating composition can include a cobalt powder. The cobalt powder can be elemental cobalt powder. In other embodiments, the cobalt powder can be any powder containing cobalt. In embodiments, the anti-fretting coating composition includes from about 5 weight % to about 80 weight % of cobalt, such as from about 10 weight % to about 70 weight % of cobalt, such as from about 20 weight % to about 60 weight % of cobalt, such as from about 40 weight % to about 50 weight % of cobalt. In certain embodiments, the anti-fretting coating composition includes from about 50 weight % to about 80 weight % of cobalt. In certain embodiments, the anti-fretting coating composition includes cobalt in a weight % range having a lower end of 5, 10, 15, 20, 25, 30, 35, 40, 45, 50, 55, 60, 65, 70, or 75 and an upper end of 80, 75, 70, 65, 60, 55, 50, 45, 40, 35, 30, 25, 20, or 15, including all combinations of lower and upper ranges, such as 15-65, or 45-75, or 35-80 or 55-80.

In embodiments, the anti-fretting coating composition includes an aluminum-containing powder. For example, the anti-fretting coating composition can include an aluminum-containing powder, such as an aluminum oxide powder ($Al_2O_3$). In embodiments, the anti-fretting coating composition can include from about 1 weight % to about 80 weight % of aluminum-oxide, such as from about 10 weight % to about 70 weight % of aluminum oxide, such as from about 20 weight % to about 60 weight % of aluminum-oxide, such as from about 30 weight % to about 50 weight % of aluminum oxide. In certain embodiments, the anti-fretting coating composition includes from about 10 weight % to about 50 weight % of aluminum oxide. In certain embodiments, the anti-fretting coating composition includes aluminum-oxide in a weight % range having a lower end of 1, 5, 10, 15, 20, 25, 30, 35, 40, 45, 50, 55, 60, 65, 70, or 75 and an upper end of 80, 75, 70, 65, 60, 55, 50, 45, 40, 35, 30, 25, 20, 15, 10 or 5, including all combinations of lower and upper ranges, such as 5-65, or 5-40, or 15-35 or 20-40.

In certain embodiments, the anti-fretting coating composition can include tantalum. For example, the anti-fretting coating composition can include a tantalum-containing powder, such as elemental tantalum powder. In embodiments where tantalum is included, the anti-fretting coating composition can include from about 10 weight % to about 20 weight % of tantalum. In certain embodiments, the anti-fretting coating composition includes tantalum in a weight % range having a lower end of 0, 5, 10, or 15 and an upper end of 20, 15, 10 or 5, including all combinations of lower and upper ranges, such as 0-20, or 5-15, or 5-20 or 10-20.

Additional additives can be added to the anti-fretting coating composition in order to modify desired properties of the resulting anti-fretting coating. For example, in order to improve damping qualities of the anti-fretting coating, additives can be included in the anti-fretting coating composition that increase the viscoelasticity of the resulting anti-fretting coating. This essentially increases the impact wear resistance of the coating. Accordingly, in embodiments, the anti-fretting coating composition includes a viscoelasticity-modifying composition. The viscoelasticity-modifying composition can include a combination of oxide powders, such as calcium oxides, aluminum oxides, silicon oxides, and combinations thereof. In embodiments, the viscoelasticity-modifying composition includes from about 25 weight % to about 40 weight % of calcium oxide. In embodiments, the viscoelasticity-modifying composition includes from about 10 weight % to about 40 weight % of aluminum oxide. In embodiments, the viscoelasticity-modifying composition includes from about 20 weight % to about 70 weight % of silicon dioxide. Other oxides, such as iron oxides, titanium oxides, and combinations thereof can be added in order to tune final properties of the resultant anti-fretting coating. For example, in embodiments, up to 8 weight % of iron oxides can be added to the viscoelasticity-modifying composition. In other embodiments, up to 10 weight % of titanium oxides can be added to the viscoelasticity-modifying composition. In embodiments, the viscoelasticity-modifying composition can include one or more of iron oxide, titanium dioxide, nickel oxide, boron oxide, or combinations thereof, where the weight percent of these additional additives does not exceed 10 weight % of the total weight of the viscoelasticity-modifying composition. The anti-fretting coating composition can include up to 20 weight %, for example from about 5 weight % to about 10 weight %, of the viscoelasticity-modifying composition. The amount of viscoelasticity-modifying composition included in the anti-fretting coating composition can be adjusted depending on the desired operating temperature range for the resultant coated component. In certain embodiments, the anti-fretting coating composition includes the viscoelasticity-modifying composition in a weight % range having a lower end of 0, 1, 2, 3, 4, 5, 6, 7, 8, 9, or 10 and an upper end of 20, 19, 18, 17, 16, 15, 14, 13, 12, 11, 10, 9, 8, 7, 6, or 5, including all combinations of lower and upper ranges, such as 0-20, or 2-12, or 3-8, or 5-15, or 3-20 or 4-16.

To form the viscoelasticity-modifying composition various oxide powders, such as calcium oxide, aluminum oxide, silicon oxide, iron oxide, nickel oxide, boron oxide, titanium oxide, and combinations thereof can be mixed together in their desired amounts to form the viscoelasticity-modifying composition. The viscoelasticity-modifying composition can then be added to the cobalt powder and aluminum oxide powder composition in order to form the anti-fretting coating composition. In other embodiments, each component of the anti-fretting coating composition can be combined and mixed without separately mixing the components of the viscoelasticity-modifying composition.

The powders included in the anti-fretting coating composition include a plurality of particles. The plurality of particles can have a median particle size of from about 1 μm to about 30 μm, such as from about 5 μm to about 30 μm, such as from about 10 μm to about 25 μm, such as from about 15 μm to about 20 μm.

Once formed, the anti-fretting coating composition can be applied to the desired substrate surface to form an anti-fretting coating on the substrate of a component. For example, the anti-fretting coating composition can be applied to the substrate via any suitable process. One exemplary process includes a plasma spray process, such as air plasma spray. Generally, plasma spray processes include the spraying of molten or heat softened material onto a surface to provide the coating. Coating material, typically in the form of a powder, is injected into a plasma flame, where it is heated and then accelerated at a desired velocity towards the desired surface. Layers of coating composition material can be deposited on the substrate until the desired coating thickness is achieved. In embodiments, the anti-fretting coating can have a thickness of from about 0.5 mils to about 20 mils, such as from about 2 mils to about 18 mils, such as from about 5 mils to about 16 mils, such as from about 8 mils to about 15 mils. In other embodiments, it is contemplated that the anti-fretting coating composition can be applied via any other suitable process such as slurry spray processes, slurry dip processes, powder spray processes, powder layer dispersion processes, and combinations thereof. For certain of these processes, application of the anti-fretting coating composition on the component can be followed by external or in-situ sintering.

The anti-fretting coating composition can be applied to a substrate of a component to form a component having an anti-fretting coating thereon. The component may include a metallic substrate or a substrate having a metallic layer that has a surface exposed to wear or fretting during operation. The component can be a metal component comprised of a metal alloy or superalloy, including nickel-based superalloys, cobalt-based superalloys, titanium-based superalloys, iron-based superalloys, or combinations thereof.

In the case of a superalloy material, the superalloy is typically formed of a nickel-based or a cobalt-based alloy, wherein nickel or cobalt, respectively, is the single greatest element in the superalloy by weight. Illustrative nickel-based superalloys include at least about 40 wt. % Ni, and at least one component from the group consisting of cobalt, chromium, aluminum, tungsten, molybdenum, titanium, and iron. Examples of nickel-based superalloys are designated by the trade names Inconel®, Nimonic®, Rene® (e.g., Rene®80-, Rene®95, Rene®142, and Rene®N5 alloys), and Udimet®, and include directionally solidified and single crystal superalloys. Illustrative cobalt-based superalloys include at least about 30 wt. % Co, and at least one component from the group consisting of nickel, chromium, aluminum, tungsten, molybdenum, titanium, and iron. Examples of cobalt-based superalloys are designated by the trade names Haynes®, Nozzaloy®, Stellite® and Ultimet®.

In other embodiments, the component can be a non-metallic component. For example, the component can be formed from a polymer matrix composite material (PMC) or a ceramic matrix composite (CMC) material, having high temperature capability. Composite materials generally comprise a fibrous reinforcement material embedded in matrix material, e.g., a polymer or ceramic matrix material. The reinforcement material serves as a load-bearing constituent of the composite material, while the matrix of a composite material serves to bind the fibers together and act as the medium by which an externally applied stress is transmitted and distributed to the fibers.

In embodiments, the component can be a non-metallic based component, such as a component formed from a CMC and/or a PMC material having a metal layer thereon. For example, certain components formed from composite materials may be at least partially coated with a metal coating forming a metal layer on the composite component. Thus, in embodiments, the anti-fretting coating composition can be applied to a composite component having a metal layer thereon. In such embodiments, the anti-fretting coating composition can be applied to both the metal layer on the composite component and also directly on the composite material itself. In other embodiments, it is contemplated that the anti-fretting coating composition is applied only to a metal layer present on a composite component.

In certain embodiments, one or more additional coatings may be disposed on the component. For example, one or more environmental barrier coatings or thermal barrier coatings may be applied on the substrate prior to application of the anti-fretting coating composition disclosed herein. Thus, one or more additional coatings or coating systems may be sandwiched between the component substrate and the anti-fretting coating disclosed herein.

Typically, the substrate comprises a component of a turbine assembly, such as a gas turbine assembly. Exemplary components include, but are not limited to a turbine nozzle, turbine blade, shroud, shroud hanger, pressure balance seal, or combustor component. Such turbine components are generally subject to part-to-part wear due to abutting contact with each other or with other components of the turbine engine. Furthermore, while exemplary aspects provided herein are directed to abutting shroud segments, the disclosure is not so limited. For example, it is conceivable that the anti-fretting coating disclosed herein could be applied to any component of gas turbine engine subject to impact that causes wear. More importantly, the anti-fretting coatings disclosed herein can be applied to components of the gas turbine engine in areas of the engine that experience operating temperatures up to 850° F. and greater, such as greater than 1800° F. and up to 2650° F.

Wear, such as fretting, can damage certain engine components rendering them in need of repair or replacement. Replacement of engine components can be costly and time-consuming. As engine sizes increase and increased engine performance is desired, certain sections of turbine engines, e.g., high bypass turbofan engines, are capable of very high operating temperatures, such as those above 1800° F. Known wear coatings oxidize or gall at such temperatures, impairing the functionality of such known coatings. Advantageously, the anti-fretting coating compositions disclosed herein maintain functionality at temperatures of about 800° F. or greater, including up to temperatures of 2650° F., which is higher than other anti-fretting coatings. Since the coated components provided herein prevent fretting wear on the surfaces of the components, repair and replacement of such parts is reduced. Other advantages of the subject matter described herein also may be realized by those of ordinary skill in the art.

Example anti-fretting coating compositions in accordance with the present invention were compared to commercially available anti-wear coatings according to a material wear test. A sintered pellet was prepared including 80 wt. % cobalt and 20 wt. % alumina ($Al_2O_3$). Additionally, a disc of IN718 was spray coated with a superalloy T800 composition. T800 is a cobalt-molybdenum-chromium superalloy that is often used for wear resistance, corrosion resistance, high-temperature resistance, and oxidation resistance. Both pellet and coated disc were subjected to a material wear test whereby erodent particles comprising silica having a particle size of 250 μm were accelerated at the pellets at a test velocity of 120 m/s at room temperature. Damage depth of the surface of each pellet was then inspected. Upon inspection, the cobalt-alumina pellet had depth damage of about 60 μm, while the T800 coating on IN718 disc had depth damage of about 160 μm. Thus, the cobalt-alumina alloy was more effective in preventing erosion as compared to the T800 coating. Accordingly, experimental results illustrate that the cobalt-alumina coating exhibited higher ductility and impact wear resistance as compared to a conventionally sprayed T800 coating.

Further aspects of the invention are provided by the subject matter of the following clauses:

An anti-fretting coating composition, comprising or consisting of or consisting essentially of: from about 5 weight % to about 80 weight % of a cobalt-containing powder; and from about 1 weight % to about 80 weight % of an aluminum-oxide powder.

The anti-fretting coating composition of any preceding clause, further comprising or consisting of or consisting essentially of from about 1 weight % to about 20 weight % of a tantalum-containing powder.

The anti-fretting coating composition of any preceding clause, further comprising or consisting of or consisting essentially of a viscoelasticity-modifying composition comprising calcium oxide, aluminum oxide, and silicon dioxide.

The anti-fretting coating composition of any preceding clause, wherein the viscoelasticity-modifying composition comprises or consists of or consists essentially of from about 25 weight % to about 50 weight % calcium oxide, from about 10 weight % to about 40 weight % of aluminum oxide, and from about 20 weight % to about 65 weight % of silicon dioxide.

The anti-fretting coating composition of any preceding clause, comprising or consisting of or consisting essentially of from about 5 weight % to about 20 weight % of the viscoelasticity-modifying composition.

The anti-fretting coating composition of any preceding clause, wherein the viscoelasticity-modifying composition further comprises or consists of or consists essentially of one or more additive, the one or more additives including iron oxide, titanium dioxide, nickel oxide, boron oxide, or a combination thereof, wherein the weight % of these additives does not exceed 10 wt. % of the total weight of the viscoelasticity-modifying composition.

The anti-fretting coating composition of any preceding clause, comprising or consisting of or consisting essentially of a median particle size of from about from about 0.025 μm to about 30 μm.

The anti-fretting coating composition of any preceding clause, wherein the anti-fretting coating composition is applied to a substrate to form an anti-fretting coating that is operationally stable at temperatures of from about 800° F. to about 2650° F.

The anti-fretting coating composition of any preceding clause, comprising or consisting of or consisting essentially of from about 60 weight % to about 80 weight % of the cobalt-containing powder, from about 10 weight % to about 40 weight % of the aluminum-oxide powder, from about 0 weight % to about 20 weight % of the tantalum-containing powder, and from about 0 weight % to about 20 weight % of the viscoelasticity-modifying composition.

A component, comprising: a substrate having a first contact surface shaped to cooperate with a second contact surface of an abutting member in a manner which can develop wear between the first contact surface and the second contact surface, the first contact surface and the second contact surface each having an anti-fretting coating thereon formed from an anti-fretting coating composition, the anti-fretting coating composition comprising or consisting of or consisting essentially of from about 5 weight % to about 80 weight % of a cobalt-containing powder and from about 1 weight % to about 80 weight % of an aluminum-oxide powder.

The composition or component of any preceding clause, wherein the anti-fretting coating composition comprises or consists of or consists essentially of from about 50 weight % to about 80 weight % of a cobalt-containing powder and from about 20 weight % to about 40 weight % of an aluminum-oxide powder, for example, about 60 weight % to about 80 weight % of a cobalt-containing powder and from about 20 weight % to about 40 weight % of an aluminum-oxide powder.

The component of any preceding clause, wherein the anti-fretting coating composition further comprises or consists of or consists essentially of from about 1 weight % to about 20 weight % of a tantalum-containing powder.

The component of any preceding clause, wherein the anti-fretting coating composition further comprises or consists of or consists essentially of silicon dioxide, calcium oxide, iron oxide, titanium dioxide, or combinations thereof.

The component of any preceding clause, wherein the substrate comprises or consists of or consists essentially of a nickel-based superalloy, a cobalt-based superalloy, or combinations thereof.

The component of any preceding clause, wherein the substrate comprises or consists of or consists essentially of a non-metallic substrate.

The component of any preceding clause, wherein the anti-fretting coating composition is applied to the substrate via a plasma spray process, powder spray process, slurry spray process, and combinations thereof.

The component of any preceding clause, wherein the anti-fretting coating has a thickness of from about 0.5 mils to about 20 mils.

The component of any preceding clause, wherein one or more additional coatings are disposed on the substrate and are sandwiched between the substrate and the anti-fretting coating.

The component of any preceding clause, wherein the component is suitable for use in an oxidizing atmosphere at a temperature of about 800° F. to about 2650° F.

The component of any preceding clause, wherein the component is a gas turbine engine component.

The component of any preceding clause, wherein the component is at least one of a nozzle, shroud, shroud hanger, pressure balance seal, low pressure turbine blade, high pressure turbine blade, and combustor component.

This written description uses examples to disclose the invention, including the best mode, and also to enable any person skilled in the art to practice the invention, including making and using any devices or systems and performing any incorporated methods. The patentable scope of the invention is defined by the claims and may include other examples that occur to those skilled in the art. Such other examples are intended to be within the scope of the claims if they include structural elements that do not differ from the literal language of the claims or if they include equivalent structural elements with insubstantial differences from the literal language of the claims.

What is claimed is:

1. A component, comprising:

a substrate having a first contact surface shaped to cooperate with a second contact surface of an abutting member in a manner which can develop wear between the first contact surface and the second contact surface, each of the first contact surface and the second contact surface having an anti-fretting coating thereon formed from an anti-fretting coating composition having:

from 55 weight % to 80 weight % of cobalt;

from 20 weight % to 40 weight % of an aluminum-oxide powder;

from 5 weight % to 20 weight % of a viscoelasticity-modifying composition comprising a mixture of 25 weight % to 50 weight % calcium oxide, 10 weight % to 40 weight % aluminum oxide, and 20 weight % to 65 weight % silicon dioxide, wherein the viscoelasticity-modifying composition forms a phase within the anti-fretting coating.

2. The component of claim 1, wherein the mixture of the anti-fretting coating composition further comprises from 1 weight % to 20 weight % of a tantalum-containing powder.

3. The component of claim 1, wherein the mixture of the viscoelasticity-modifying composition further comprises iron oxide, titanium dioxide, or combinations thereof.

4. The component of claim 1, wherein the substrate comprises a nickel-based superalloy, a cobalt-based superalloy, or combinations thereof.

5. The component of claim 1, wherein the substrate comprises a non-metallic substrate.

6. The component of claim 1, wherein the anti-fretting coating composition is applied to the substrate via a plasma spray process, powder spray process, slurry spray process, or combinations thereof.

7. The component of claim 1, wherein the anti-fretting coating has a thickness of from 0.5 mils to 20 mils.

8. The component of claim 1, wherein one or more additional coatings are disposed on the substrate and are sandwiched between the substrate and the anti-fretting coating.

9. The component of claim 1, wherein the component is suitable for use in an oxidizing atmosphere at a temperature of 800° F. to 2650° F.

10. The component of claim 1, wherein the component is a gas turbine engine component.

11. The component of claim 10, wherein the component is at least one of a nozzle, shroud, shroud hanger, pressure balance seal, low pressure turbine blade, high pressure turbine blade, or combustor component.

12. The component of claim 1, wherein the mixture of the viscoelasticity-modifying composition further comprises one or more additives, the one or more additives including iron oxide, titanium dioxide, nickel oxide, boron oxide, or a combination thereof.

13. The component of claim 12, wherein the one or more additives have a weight % that does not exceed 10 wt. % of a total weight of the mixture of the viscoelasticity-modifying composition.

* * * * *